US006472850B2

(12) United States Patent
Fletcher et al.

(10) Patent No.: US 6,472,850 B2
(45) Date of Patent: Oct. 29, 2002

(54) METHOD AND APPARATUS FOR DETERMINING VOLTAGE REGULATOR TAP POSITION

(75) Inventors: David Fletcher, Simsbury, CT (US); Richard Dean Blackburn, Conover, NC (US); Joseph Rao, Avon, CT (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/728,953

(22) Filed: Dec. 1, 2000

(65) Prior Publication Data

US 2002/0067153 A1 Jun. 6, 2002

(51) Int. Cl.[7] ..... G05F 1/153
(52) U.S. Cl. ..... 323/257; 323/256
(58) Field of Search ..... 323/255, 256, 323/257, 260, 263, 340, 341, 343

(56) References Cited

U.S. PATENT DOCUMENTS

| | | | | |
|---|---|---|---|---|
| 4,130,789 A | | 12/1978 | Neumann | 323/43.5 R |
| 5,550,459 A | | 8/1996 | Laplace | 323/255 |
| 5,550,460 A | | 8/1996 | Bellin et al. | 323/255 |
| 5,552,696 A | | 9/1996 | Trainor et al. | 323/275 |
| 5,568,398 A | | 10/1996 | Trainor | 364/492 |
| 5,619,121 A | | 4/1997 | Trainor | 323/256 |
| 5,633,580 A | | 5/1997 | Trainor et al. | 323/256 |
| 5,646,512 A | * | 7/1997 | Beckwith | 323/257 |
| 5,804,954 A | | 9/1998 | Laplace, Jr. | 323/256 |
| 5,920,467 A | * | 7/1999 | Bowyer et al. | 363/37 |
| 6,072,305 A | | 6/2000 | Trainor et al. | 323/255 |
| 6,100,674 A | * | 8/2000 | Dohnal et al. | 363/256 |

* cited by examiner

*Primary Examiner*—Matthew Nguyen
(74) *Attorney, Agent, or Firm*—Cantor Colburn LLP

(57) ABSTRACT

A method for dynamically determining tap position in a step voltage regulator is disclosed. A present tap position is determined and the value of an applied voltage across a tap changing mechanism is measured. Based upon the value of the applied voltage, a directional change in the tap position is detected. A trigger signal is also generated which is responsive to a detected change in tap position. Finally, a new tap position is calculated based upon the present tap position and the directional change in the tap position, when the trigger signal indicates that a change in tap position has taken place.

22 Claims, 4 Drawing Sheets

METHOD AND APPARATUS FOR DETERMINING VOLTAGE REGULATOR TAP POSITION

BACKGROUND OF THE INVENTION

This invention relates generally to industrial voltage regulators. More particularly, this invention relates to a method and apparatus for determining the selected tap position of a voltage regulator having a plurality of selectable tap positions.

A step voltage regulator is an autotransformer used to maintain a relatively constant voltage level within a power distribution system. Without the use of such voltage regulators, the voltage level of the system could fluctuate significantly and cause damage to electrically powered equipment. Typically, step voltage regulators include an input voltage which may fluctuate from the desired operating voltage, depending upon the existing load conditions. In order to regulate the output voltage to a more constant output level, a buck/boost winding is serially connected with an output winding on the load side. The buck/boost winding has a series of taps removably connectable to corresponding taps located on a tap changing mechanism. The taps of the buck/boost winding are incrementally located upon the winding to provide discrete, incremental changes in the output winding turns. A reversible motor, responsive to a control signal, drives the tap changing mechanism to the appropriate tap on the buck/boost winding to either increase or decrease the output voltage as needed. A neutral position may also be used, such that the buck/boost winding is disconnected from the output winding.

Operators of industrial electrical power installations having step voltage regulators monitor information on tap positions because of the effect on system operation, maintenance and performance analysis. In addition, certain supplemental functions in the control circuitry may depend on the tap position. One method of determining tap position and tap position changes is through the use of a position sensor, mechanically coupled to a tap changing mechanism. This provides a direct measurement of a tap position and its associated direction of movement. However, the use of mechanical position sensors in this application is a fairly recent trend, and thus many voltage regulators are not so equipped. Without a direct position measurement, therefore, an indirect method of tap position detection is needed.

Previously known methods of indirect tap position sensing include the use of current sensors to detect the energization of the tap changing mechanism motor. A counting mechanism may keep track of the number of "increasing" and "decreasing" voltage tap changes made by the tap changer. However, using this method by itself only provides the operator with information on the relative change in tap position; the exact tap position will remain unknown unless an initial tap position is first determined. One method of initialization known in the prior art is to provide a detecting mechanism for detecting when the tap position reaches the neutral position. Until such time, the exact tap position remains unknown. Furthermore, upon deenergization and reenergization of the power system, the control must again wait until the neutral position is reached before knowing the exact tap position.

It is thus desirable to provide a method and apparatus for determining a voltage regulator tap position while addressing the aforementioned drawbacks and deficiencies.

BRIEF SUMMARY OF THE INVENTION

The above discussed and other drawbacks and deficiencies are overcome or alleviated by a method for dynamically determining tap position in a step voltage regulator. A present tap position is determined and the applied voltage across a tap changing mechanism is measured. Based upon the applied voltage, a directional change in the tap position is detected. A trigger signal is also generated which is responsive to a detected change in tap position. Finally, a new tap position is calculated based upon the present tap position and the directional change in the tap position, when the trigger signal indicates that a change in tap position has taken place.

In one embodiment, a first voltage is measured across the tap changing mechanism. A second voltage is also measured across the tap changing mechanism, with the first and second voltages being used to indicate a directional change in tap position. In another embodiment, the directional change in tap position is detected by comparing signal phase characteristics between the first voltage and the second voltage.

The above discussed and other features and advantages of the present invention will be appreciated and understood by those skilled in the art from the following detailed descriptions and drawings.

BRIEF DESCRIPTION OF THE DRAWINGS

Referring to the exemplary drawings wherein like elements are numbered alike in the several Figures.

DETAILED DESCRIPTION OF THE INVENTION

Figure 1:
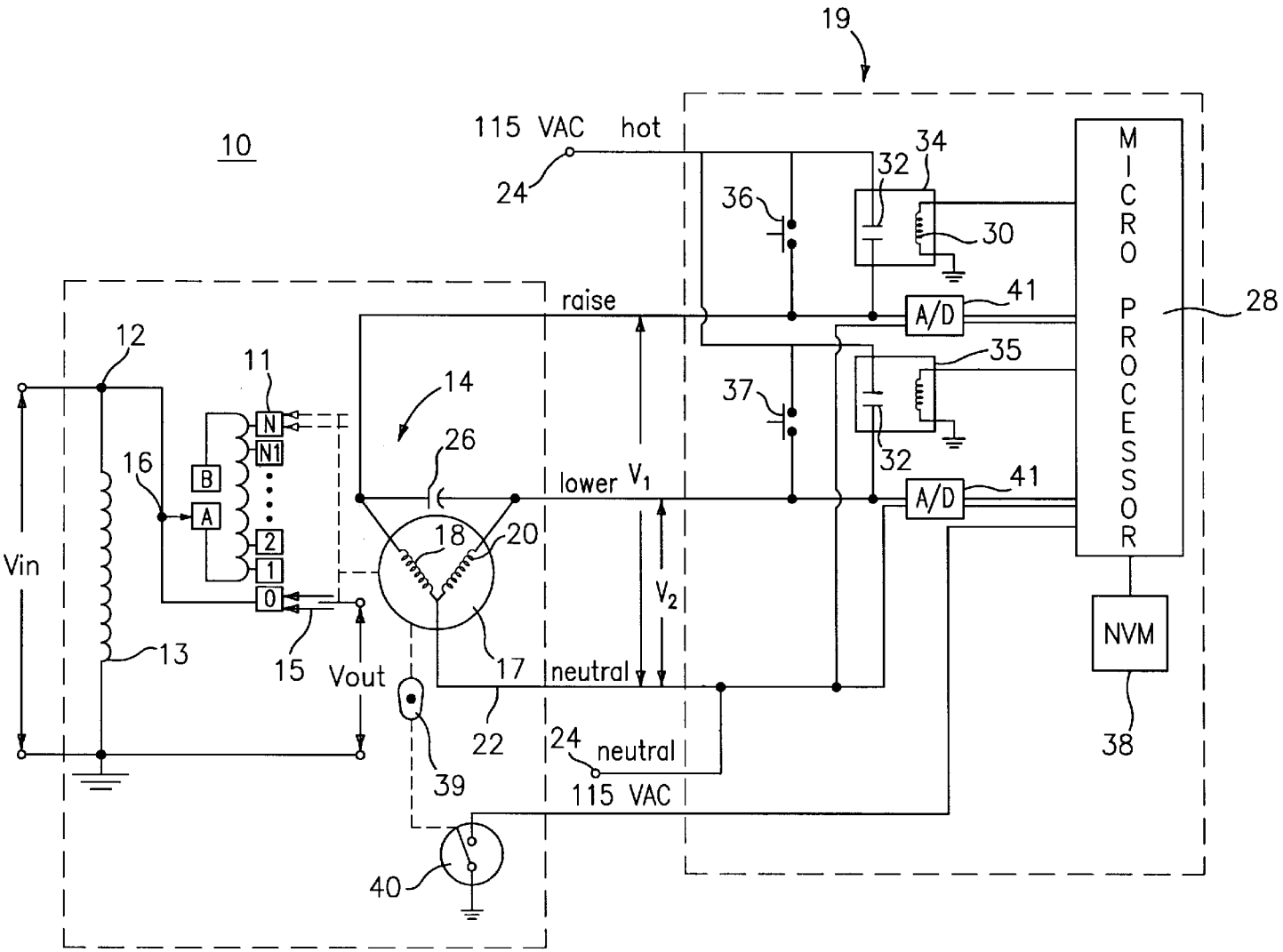
FIG. 1 is a simplified schematic diagram of a voltage regulator, including an autotransformer, a tap changing mechanism and a motor control circuit.

Referring initially to FIG. 1, a voltage regulator 10 has a series of removably selectable taps 11 for modifying an input voltage $V_{in}$ of a power system (not shown) to provide a relatively constant output voltage $V_{out}$ Voltage regulator 10 comprises an autotransformer 12 having windings 13 across which the input voltage $V_{in}$ is applied. The taps 11 include a neutral tap 0 and taps 1, 2, . . . N−1, N for raising (boosting) or lowering (bucking) the input voltage $V_{in}$. The autotransformer 12 can be, for example, a General Electric VR-1 series voltage regulator.

The taps 11 are selected by means of an electrically powered tap changing mechanism 14, which is capable of activating any of the taps 0, 1, 2, . . . , N−1, N by moving a moveable tap 15 into contact with a selected tap 11. If moveable tap 15 is entirely on the neutral tap 0, then the output voltage $V_{out}$ is equal to the input voltage $V_{in}$. Whenever the moveable tap 15 simultaneously contacts any two adjacent taps 11, then the output voltage $V_{out}$ is equal to a voltage that is halfway between the voltages at the adjacent taps 11. Thus, if reversing switch 16 is positioned on the A terminal and moveable tap 15 is located on the neutral tap 0 and tap 1, then the output voltage $V_{out}$ is one step raised. If reversing switch is positioned on the B terminal and moveable tap 15 is located on tap N and neutral tap 0, then the output voltage $V_{out}$ is one step lowered.

By way of example, if the total number of taps (excluding neutral tap 0) is eight (8), it can be seen that the tap changer mechanism 14 can thus move the moveable tap 15 through sixteen discreet raise positions, with the reversing switch 16 on the A terminal. Conversely, with the reversing switch 16 on the B terminal, the tap changing mechanism 14 can move the moveable tap 15 through sixteen discreet lower positions. Assuming a nominal range of output voltage $V_{out}$ values within ±10% of the input voltage $V_{in}$, then each step of the tap changing mechanism 14 represents a (10÷16) or ⅝% change in output voltage $V_{out}$. Finer adjustments in output voltage may be obtained by providing a larger number of taps 11.

The tap changing mechanism 14 includes a reversible motor 17, which is a permanent, phase-split capacitor run motor having three terminals. Motor 17 is operably connected to moveable tap 15, causing moveable tap 15 to move between taps 11. Motor 17 is also operably connected to a cam 39, causing cam 39 to rotate as moveable tap 15 is moved. A "raise" winding 18 in motor 17 is energized upon command from a motor control circuit 19 to perform a raise tap position operation. Correspondingly, a "lower" winding 20 in motor 17 is energized upon command from the motor control circuit 19 to lower the tap position. A neutral terminal 22 provides the current return path for both the "raise" and "lower" windings. The motor 17 may be energized through a 115–120 volt, alternating current control power source 24. A capacitor 26 is connected between the "raise" and "lower" windings 18, 20, and provides the necessary starting torque for motor 17.

Motor control circuit 19 includes a microprocessor 28, which monitors the output voltage $V_{out}$ of the voltage regulator 10 by means of a step down transformer or other device (not shown). Depending upon the dynamic load conditions of the power system, the input voltage $V_{in}$ may be caused to fluctuate. Microprocessor 28 may be preprogrammed with set points for desired system voltage settings. If it is determined that a change in output voltage $V_{out}$ is required, the microprocessor 28 will generate a signal to either raise or lower the moveable tap 15, as the case may be. This function is accomplished with a control signal from the microprocessor 28, energizing a control relay coil 30, which in turn closes a corresponding contact 32, which connects control power source 24 to one of the two motor windings 18 or 20. In the diagram shown in FIG. 1, a relay 34 controls the application of power to the "raise" winding 18, while another relay 35 does the same for the "lower" winding 20. In addition to being energized in response to a signal from the microprocessor 28, the motor 17 may also be manually energized by switches 36 and 37. Switch 36, when depressed, connects control power source 24 to the "raise" winding 18. Likewise, switch 37, when depressed, connects control power source 24 to the "lower" winding 20.

Many voltage regulators are not equipped with a position sensor, which the control uses to determine the selected tap position on the regulator. Thus, an indirect method is used to provide the tap position information to the microprocessor 28 in control circuit 19. Broadly stated, two pieces of information are used by the microprocessor 28 to accurately determine present tap position. First, the direction (raise or lower) of the tap change is ascertained. Second, the present tap position is referenced. Without the latter, only a relative change in tap position can be determined. In the present embodiment, the microprocessor 28 stores the prior tap position in non-volatile memory 38, such as battery backed RAM, EEPROM or the like.

Cam 39 provides a mechanical link between the motor 17 and an operations trigger switch (OTS) 40. The OTS 40, when closed, indicates that an incremental change in the position of moveable tap 15 has taken place and provides a corresponding signal to the microprocessor 28. The purpose of the OTS 40 is described in further detail hereinafter. Finally, a pair of analog to digital (A/D) converters 41 are used to digitize signals representing the voltages $V_1$ and $V_2$ applied across the "raise" and "lower" windings (18, 20 in FIG. 1), respectively. The digitized representations of $V_1$ and $V_2$ are sent to the microprocessor 28 for comparison therebetween to determine the direction of the tap change, as is described later in greater detail.

Figure 2:
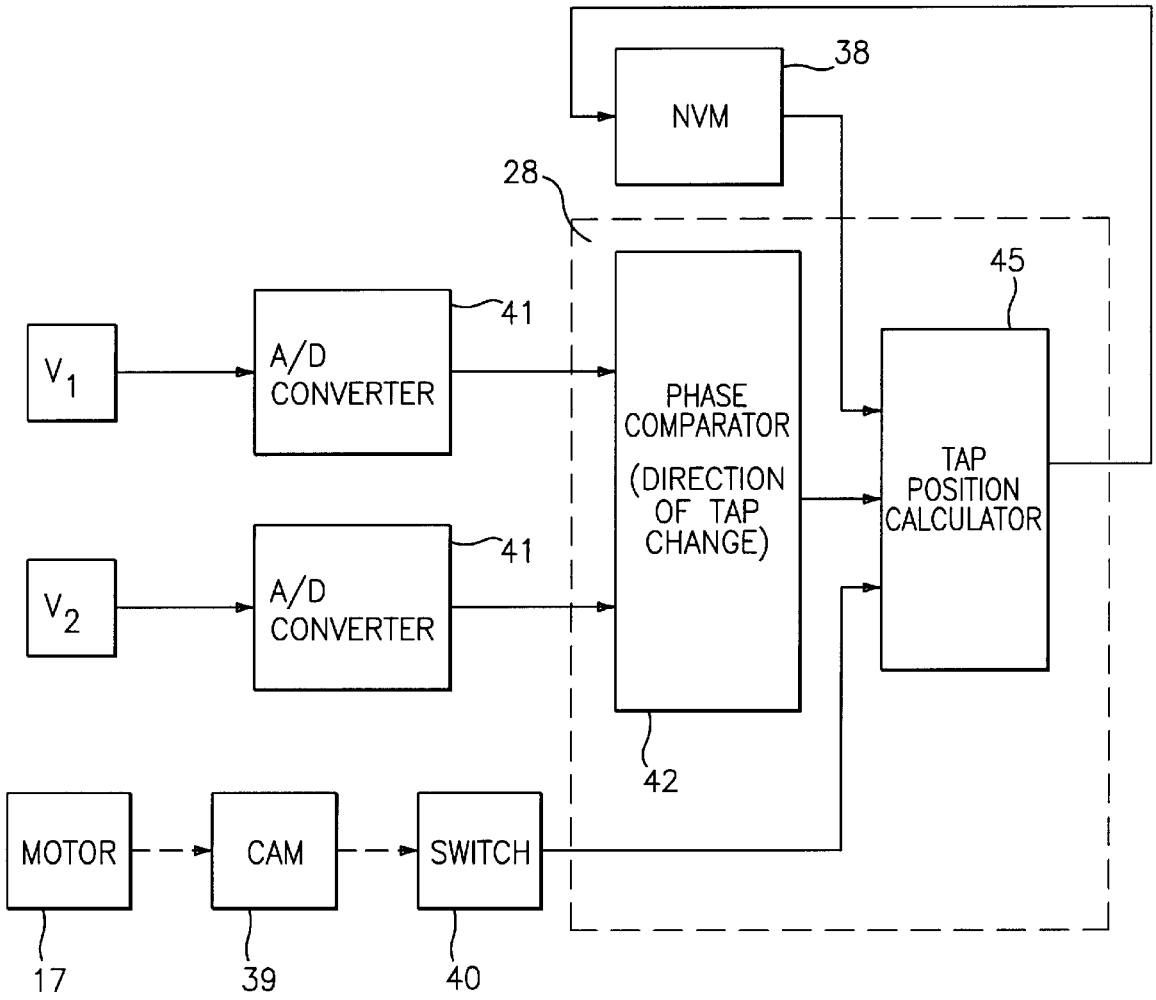
FIG. 2 is a block diagram illustrating the steps executed by an embodiment of the invention to determine tap position.

Referring now to FIG. 2, the location of moveable tap 15 is determined by microprocessor 28 through three parameters. First, the voltages across the "raise" and "lower" windings $V_1$, $V_2$ are measured and compared (after being digitized by A/D converters 41) with one another by phase comparator 42 to determine which winding has been energized (either upon a command from the microprocessor 28 or by the closing of one of the manual pushbutton switches 36, 37). In the present embodiment, the phase comparator 42 is a programmed function of the microprocessor 28. It should be recognized, however, that phase comparator may be embodied in electronic circuitry as well. Second, the OTS 40 operates in response to a movement in tap position. It should be noted that the trigger signal generated by the OTS 40 is without regard to the direction of the tap change. After receiving a trigger signal from the OTS 40, the microprocessor 28 then checks the last known output of the phase comparator 42 to see whether a raise or lower operation was last performed. Third, the direction of the operation (raise or lower) is then taken in conjunction with the present tap position, stored in non-volatile memory 38, to determine the new tap position through calculator 45. The new tap position is then stored in non-volatile memory 38.

Referring generally now to FIGS. 1–6, the phase comparator 42 determines the direction of a tap change command by comparing the phases of applied voltages across both the "raise" and "lower" windings 18, 20 of the motor 17 and determining which voltage signal leads the other in phase. Whichever voltage signal of the two is the lagging voltage signal corresponds to the specific motor function (raise tap or lower tap) executed. For example, if the power system load requirements call for an increase in voltage, a "tap raise" function is executed automatically in response to a signal from the microprocessor 28, or manually by an operator. In either case, a raise switch contact (32 or 36) is closed in the motor control circuit 19, thus applying motor control voltage 24 (FIG. 1) at $V_1$ and energizing the "raise" winding 18 in the motor 17. At the same time, the combination of the capacitive coupling by capacitor 26, along with the inductance properties of the motor 17 windings, results in an induced voltage across the "lower" winding 20 at $V_2$. Further, the voltage induced at $V_2$ is lead phase-shifted, approximately 90°, from the voltage at $V_1$.

Similarly, if the power system requirements call for a decrease in output voltage, the microprocessor 28 or system operator initiates a "tap lower" function. This time, a lower switch contact (32 or 37) is closed, resulting in the application of the motor control voltage 24 at $V_2$. The "lower" winding 20 is energized, with a leading phase voltage being induced at $V_1$. Again, the "raise" winding 18, which is not directly energized, nevertheless has an induced voltage which leads by approximately 90°.

Figure 3:
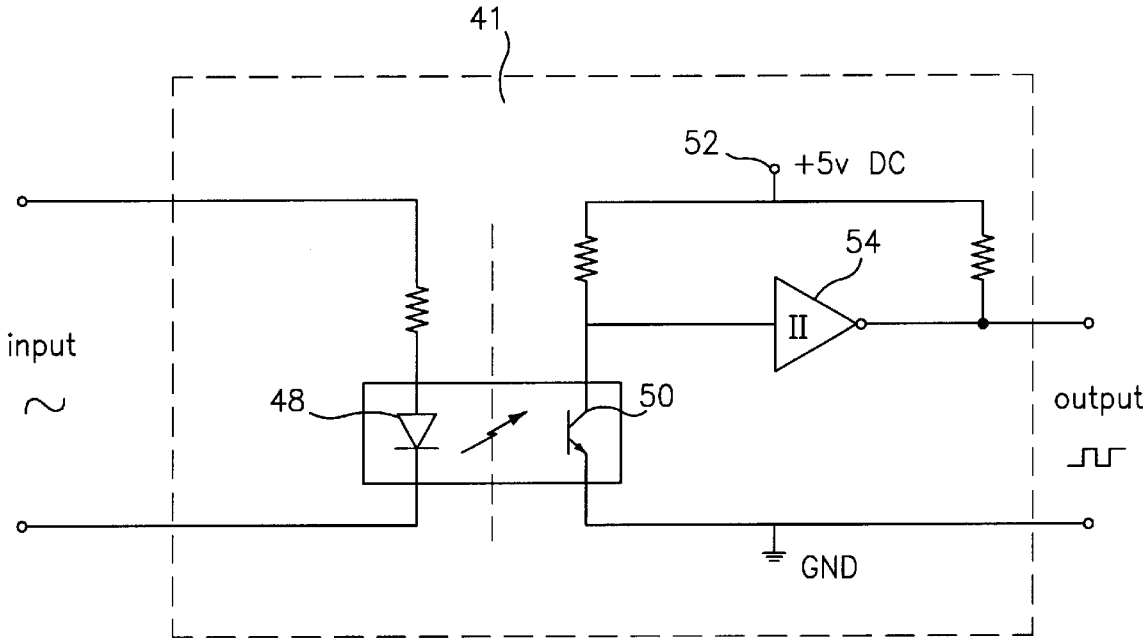
FIG. 3 is a schematic diagram of an A/D converter used in the control circuit shown in FIG. 1.
Figure 4:
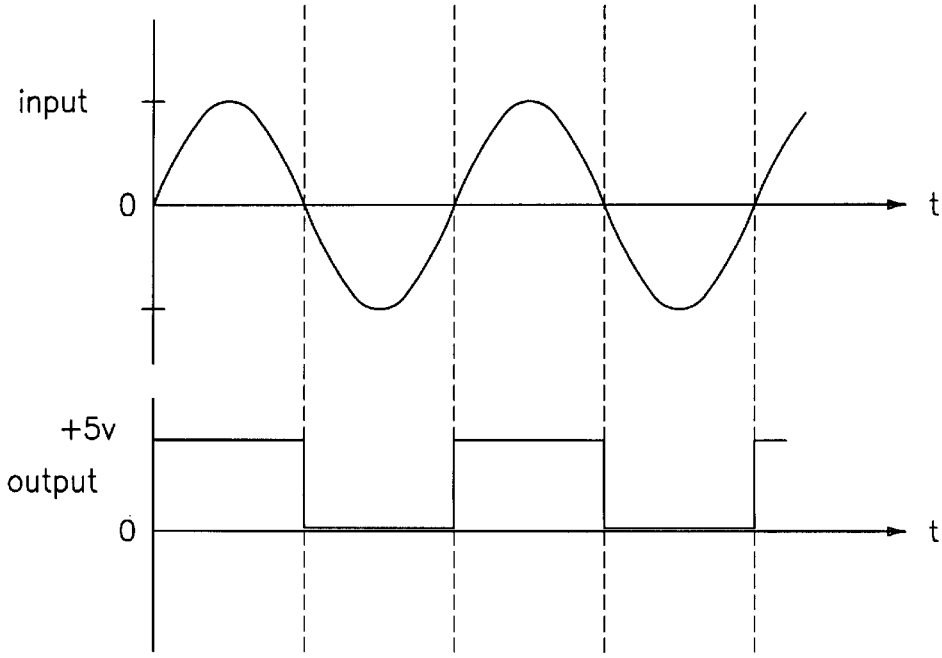
FIG. 4 is an input/output waveform diagram for the A/D converter shown in FIG. 3.

Referring now to FIGS. 3 and 4, the A/D converters 41 are used to process the voltage signals at $V_1$ and $V_2$ for phase comparison therebetween. Each AID converter 41 receives a sinusoidal AC voltage input ($V_1$ or $V_2$ in FIG. 1) and produces a corresponding digital output for processing by the microprocessor logic circuitry. As shown in FIG. 3, the output side of the A/D converter 41 is optically coupled to, and electrically isolated from the input side. A photodiode 48 is optically coupled to a phototransistor 50 powered by a +5 VDC source 52. During the positive half cycle of the input AC voltage, current passing through photodiode 48 causes photons to be emitted, thereby switching phototransistor 50 "on". An inverter 54 is coupled one of the transistor 50 terminals to produce a "high" or +5 VDC output when the transistor 50 is activated. During the negative half cycle of the input voltage, no current flows through photodiode 48, thereby keeping transistor 50 "off". Thus, the output voltage of the A/D converter 41 is "low", or 0 volts. FIG. 4 illustrates the input AC voltage and corresponding output DC voltage for the A/D converter 41.

Figure 5:
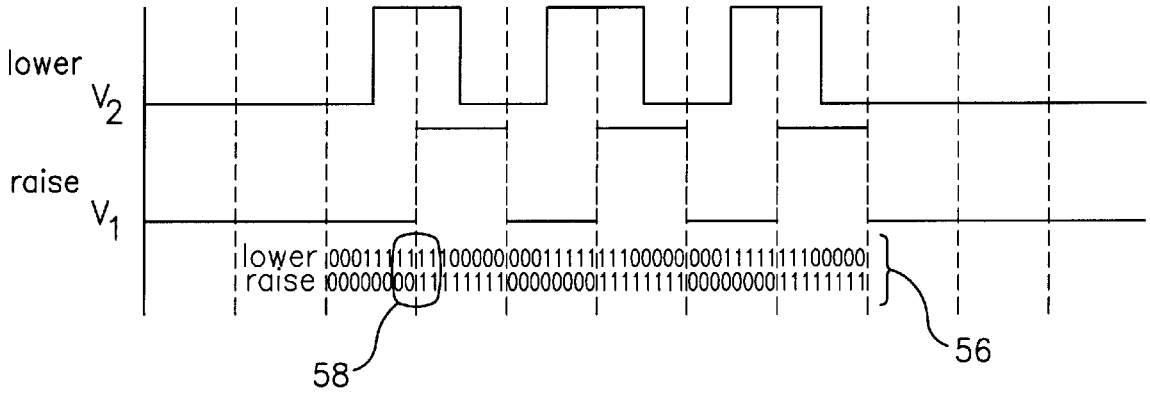
FIG. 5 is an output waveform diagram comparing the digitized representations of the motor voltage control signals during a raise tap operation.

FIG. 5 illustrates a sample waveform diagram corresponding to the digitized representations of the voltage signals at $V_1$ and $V_2$ when the "raise" winding 18 of the motor 17 is energized. As can be seen from the diagram in FIG. 5, the digitized version of the $V_2$ (lower) voltage signal waveform leads the $V_1$ (raise) voltage signal by roughly 90°. In order for the phase comparator 42 to detect and confirm a phase differential between $V_1$ and $V_2$, the digital outputs of A/D converters 41 are repetitively sampled at approximately 1 millisecond intervals. Accordingly, for a 60 Hz signal, there will be approximately eight (8) samplings for $V_1$ and $V_2$ per half cycle. Each sample is shown represented in binary form where the digit "1" corresponds to a high voltage value (e.g., above 0 volts), and the digit "0" corresponds to a low voltage value (e.g., 0 volts). It should be noted, however, that the sampling frequency and the signal frequencies are asynchronous, meaning that there are not always exactly eight samplings per half cycle.

Referring now to the series of digital samplings 56 shown under the waveforms in FIG. 5, it can be seen that for the first three samplings both the raise ($V_1$) and lower ($V_2$) voltages are at the zero, or low state. The fourth sampling reflects the change in $V_2$ from low to high, while $V_1$ remains low. This pattern remains unchanged until the ninth sampling, where $V_1$ and $V_2$ are now both at the high state. Subsequently, both $V_1$ and $V_2$ remain high until the twelfth sampling, where $V_2$ returns to low while $V_1$ remains high. This remains unchanged until the beginning of the next cycle (seventeenth sampling), where $V_1$ and $V_2$ are once again both low.

The aforementioned sampling results will be repeated so long as the motor 17 (FIG. 1) performs the raise tap function. Once the motor 17 is deenergized, the control voltage 24 is removed and the digitized representations of both $V_1$ and $V_2$ will be continuously low until one of the windings (18 or 20) is then energized again.

In analyzing the series of samplings for $V_1$ and $V_2$, the phase comparator 42 looks for a sequence 58 of four (4) samplings wherein one voltage signal is high and the other low during the first two (2) samplings thereof, and both voltage readings are high during the next two samplings. This pattern represents a phase shift between $V_1$ and $V_2$. Depending upon which signal goes from low to high (while the other signal remains high) during this four sampling pattern determines which motor function has been activated. Thus, from FIG. 5, it is seen that in the seventh through the tenth samplings in sequence 58, $V_1$ has changed from low to high, while $V_2$ remains at high. Therefore, $V_1$ is the signal that is lagging, meaning that a raise function is performed by the motor 17. In response to this determination, phase comparator 42 (FIG. 2) sends a signal to tap position calculator 45 indicating that the last known direction was "raise".

Figure 6:
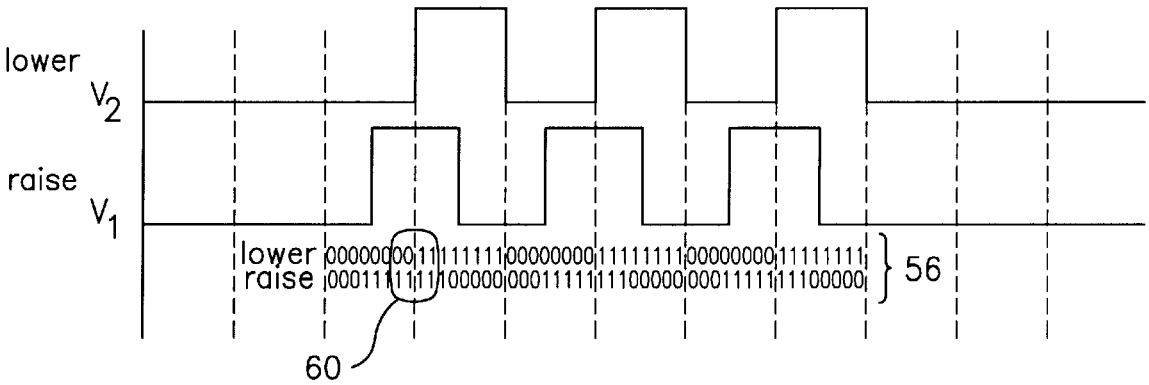
FIG. 6 is another output waveform diagram comparing the digitized representations of the motor voltage control signals during a lower tap operation.

FIG. 6 illustrates another waveform comparison of the digitized representations of $V_1$ and $V_2$. This time, it is seen that $V_2$ lags $V_1$ by approximately 90°. Again, the same pattern comparison method is used, wherein a sequence 60 of four samplings is found such that one voltage signal is high and the other low during the first two samplings thereof, and then both voltage readings are high during the next two samplings. In this case, the pattern is found again during samplings 7 through 10. Since it is $V_2$ that goes from low to high while $V_1$ remains high, it is confirmed that $V_2$ lags $V_1$. Therefore, a lower function is performed by the motor 17 (FIG. 1). In response to this determination, phase comparator 42 (FIG. 2) sends a signal to tap position calculator 45 indicating that the last known direction was "lower".

In addition to detecting a phase differential between the motor voltage control signals, the phase comparator 42 may also be used in a diagnostic capacity. For example, if a problem with the motor 17 occurred during its operation (such a shorted capacitor 26), the phase comparator 42 could be programmed to detect abnormal phase patterns. In the case of a shorted capacitor 26, both voltage control signals would be in phase instead of 90 degrees apart.

The method and apparatus for determining voltage regulator tap position described herein allows the determination of a voltage regulator tap position while alleviating the drawback and deficiencies of the prior art. The present invention provides a measurement of tap position without the use of mechanical position sensors. In addition, the present invention allows the determination of a voltage regulator tap position even in instances where the change was not initiated by the microprocessor. In other words, even if the motor 17 is energized in either direction by pushbutton switches 36 or 37, the information regarding change in position is nonetheless fed back to microprocessor 28. In one embodiment of the present invention, the present embodiment allows the position of the voltage regulator tap to be determined without requiring the tap changer to cycle through a neutral position. In this embodiment, the microprocessor 28 stores the present tap position in non-volatile memory 38, so that the prior tap position is available to microprocessor 28 even after a loss of power.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A method for dynamically determining tap position in a step voltage regulator, comprising:

determining a present tap position;

measuring an applied voltage across a tap changing mechanism;

detecting a directional change in the present tap position based upon the applied voltage;

generating a trigger signal responsive to the change in the present tap position; and calculating a new tap position based upon the present tap position and the directional change in the present tap position when the trigger signal indicates that a change in tap position has taken place.

2. The method of claim 1, further comprising:

measuring a first voltage across said tap changing mechanism;

measuring a second voltage across said tap changing mechanism; and using said first and second voltages to determine a directional change in said tap position.

3. The method of claim 2, wherein said change in said directional tap position is detected by comparing signal phase characteristics between said first voltage and said second voltage.

4. The method of claim 3, wherein an increase in said tap position is determined when said first voltage lags said second voltage.

5. The method of claim 3, wherein a decrease in said tap position is determined when said second voltage lags said first voltage.

6. The method of claim 3, further comprising converting said first and second voltages from a sinusoidal, alternating voltage input to a digital representation of said first and second voltages.

7. The method of claim 6, further comprising repetitively sampling said digital representations of said first and said second voltages, said sampling being indicative of said directional change in tap position.

8. The method of claim 1, wherein said generating said trigger signal responsive to said change in said tap position further comprises closing a switch, said switch mechanically coupled to a tap changing motor.

9. The method of claim 1, further comprising storing said new tap position in non-volatile memory.

10. The method of claim 1, further comprising retrieving said present tap position from non-volatile memory.

11. The method of claim 2, further comprising diagnosing proper operation of said motor by comparing said first voltage and said second voltage.

12. The method of claim 2, further comprising diagnosing proper operation of said motor by comparing signal phase characteristics between said first voltage and said second voltage.

13. A voltage regulator, including a series of selectable taps for raising or lowering an input voltage, the voltage regulator comprising:

a reversible motor having a pair of windings, including a "raise" winding and a "lower" winding;

a motor control circuit connected to a microprocessor, said microprocessor generating signals to energize said "raise" and said "lower" windings, said motor control circuit further comprising a phase comparator, said phase comparator comparing phase voltages across said "raise" and said "lower" windings; and an operations trigger switch coupled to said motor, said operations trigger switch providing a signal to said microprocessor indicative of a change in tap position.

14. The voltage regulator of claim 13, further comprising:

a first analog to digital converter, having an input connected to said "raise" winding of said motor and an output connected to said microprocessor; and a second analog to digital converter, having an input connected to said "lower" winding of said motor and an output connected to said microprocessor.

15. The voltage regulator of claim 14, wherein:

said inputs of both said first and second analog to digital converters are sinusoidal, alternating current inputs; and said outputs of both said first and second analog to digital converters are digital, direct current outputs.

16. The voltage regulator of claim 14, wherein:

said input of said first analog to digital converter is electrically isolated from, and optically coupled to, said output of said first analog to digital converter; and said input of said second analog to digital converter is electrically isolated from, and optically coupled to, said output of said second analog to digital converter.

17. The voltage regulator of claim 14, further comprising:

non-volatile memory, accessible by said microprocessor, said non-volatile memory capable of storing information on tap position.

18. A step voltage regulator, comprising:

an autotransformer having a plurality of windings across which an input power voltage is applied;

a plurality of removably selectable taps for raising or lowering said input power voltage; and a tap changing mechanism, said tap changing mechanism further comprising:

a split phase motor having a pair of windings;

a motor control circuit connected to a microprocessor, said microprocessor generating signals to energize said pair of windings, said motor control circuit further comprising a phase comparator, said phase comparator comparing phase voltages across said pair of windings; and an operations trigger switch coupled to said motor, said operations trigger switch providing a signal to said microprocessor indicative of a change in tap position.

19. The voltage regulator of claim 18, wherein said motor is coupled to a moveable tap, said moveable tap removably engageable with said plurality of removably selectable taps.

20. The voltage regulator of claim 19, wherein said motor further comprises a "raise winding" and a "lower winding".

21. The voltage regulator of claim 20, further comprising:

a first analog to digital converter, having an input connected to said "raise" winding of said motor and an output connected to said microprocessor; and a second analog to digital converter, having an input connected to said "lower" winding of said motor and an output connected to said microprocessor.

22. The voltage regulator of claim 18, further comprising:

non-volatile memory, accessible by said microprocessor, said non-volatile memory capable of storing information on tap position.

* * * * *